US011067083B2

(12) United States Patent
Huang et al.

(10) Patent No.: US 11,067,083 B2
(45) Date of Patent: Jul. 20, 2021

(54) COMPRESSOR AND AIR CONDITIONER

(71) Applicant: GREE ELECTRIC APPLIANCES, INC. OF ZHUHAI, Zhuhai (CN)

(72) Inventors: Hui Huang, Zhuhai (CN); Yusheng Hu, Zhuhai (CN); Huijun Wei, Zhuhai (CN); Jian Wu, Zhuhai (CN); Ouxiang Yang, Zhuhai (CN); Shebing Liang, Zhuhai (CN); Liping Ren, Zhuhai (CN); Huifang Luo, Zhuhai (CN); Hongwei Zhu, Zhuhai (CN); Jia Xu, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 0 days.

(21) Appl. No.: 15/301,072

(22) PCT Filed: Apr. 10, 2015

(86) PCT No.: PCT/CN2015/076290
§ 371 (c)(1),
(2) Date: Sep. 30, 2016

(87) PCT Pub. No.: WO2015/154717
PCT Pub. Date: Oct. 15, 2015

(65) Prior Publication Data

US 2017/0022988 A1 Jan. 26, 2017

(30) Foreign Application Priority Data

Apr. 10, 2014 (CN) ..... 201410143626.8

(51) Int. Cl.
*F04C 23/00* (2006.01)
*F04C 18/356* (2006.01)
*F04C 28/06* (2006.01)

(52) U.S. Cl.
CPC ..... *F04C 23/008* (2013.01); *F04C 18/356* (2013.01); *F04C 23/001* (2013.01); *F04C 28/065* (2013.01)

(58) Field of Classification Search
CPC F04C 23/00–008; F04C 28/065; F04C 28/06; F04C 23/001; F04C 23/003
See application file for complete search history.

(56) References Cited

U.S. PATENT DOCUMENTS 6,672,065 B1 * 1/2004 Choroszylow ..... F01C 1/22 417/308
10,920,776 B2 * 2/2021 Hill ..... F04C 23/02
(Continued)

FOREIGN PATENT DOCUMENTS

CN 1950611 A 4/2007
CN 101091063 A 12/2007
(Continued)

OTHER PUBLICATIONS

Merriam Webster Dictionary definition of groove, published Jan. 22, 2014, URL: https://web.archive.org/web/20140122022553/https://www.merriam-webster.com/dictionary/groove (Year: 2014).*
(Continued)

*Primary Examiner* — Devon C Kramer
*Assistant Examiner* — Thomas Fink
(74) *Attorney, Agent, or Firm* — Flener IP & Business Law; Zareefa B. Flener

(57) ABSTRACT

A compressor includes a low-pressure stage cylinder, a first high-pressure stage cylinder and a second high-pressure stage cylinder which are stacked, a partition is arranged between each two adjacent cylinders, the first and second high-pressure stage cylinders are both situated at a same side of the low-pressure stage cylinder or respectively situated at two sides of the low-pressure stage cylinder, the lower flange
(Continued)

is situated below the low-pressure stage cylinder, the first high-pressure stage cylinder and the second high-pressure stage cylinder. A first sliding sheet is provided in the first high-pressure stage cylinder, a second sliding sheet is provided in the second high-pressure stage cylinder, and a third sliding sheet is provided in the low-pressure stage cylinder. The first and the second high-pressure stage cylinders are arranged in parallel, and the first and second high-pressure stage cylinders arranged in parallel are connected to the low-pressure stage cylinder in series.

6 Claims, 14 Drawing Sheets

(56) References Cited

U.S. PATENT DOCUMENTS

| | | | | |
|---|---|---|---|---|
| 2005/0118035 | A1* | 6/2005 | Naito | F04C 18/126 417/244 |
| 2008/0003123 | A1* | 1/2008 | Byun | F04C 28/065 418/23 |
| 2008/0193310 | A1* | 8/2008 | Byun | F01C 21/0863 418/23 |
| 2009/0013714 | A1* | 1/2009 | Yamaguchi | F04C 18/02 62/510 |
| 2009/0282845 | A1* | 11/2009 | Hasegawa | F01C 1/3564 62/87 |
| 2010/0011807 | A1* | 1/2010 | Nam | F01C 21/0863 62/510 |
| 2011/0179822 | A1* | 7/2011 | Sotojima | F04C 18/322 62/510 |
| 2011/0271699 | A1* | 11/2011 | Lee | F04C 23/008 62/228.4 |
| 2012/0014816 | A1* | 1/2012 | Choi | F04C 23/001 417/244 |
| 2013/0209222 | A1* | 8/2013 | Schofield | F04C 23/001 415/62 |
| 2014/0301881 | A1* | 10/2014 | Ogata | F04C 29/04 418/63 |
| 2016/0272047 | A1* | 9/2016 | Gan | B60H 1/3223 |
| 2020/0333055 | A1* | 10/2020 | Aoki | F04C 29/0092 |
| 2021/0006103 | A1* | 1/2021 | Cho | H02K 1/146 |
| 2021/0018231 | A1* | 1/2021 | Nagahata | F25B 31/026 |
| 2021/0054842 | A1* | 2/2021 | Hirayama | F04C 23/00 |

FOREIGN PATENT DOCUMENTS

| | | | |
|---|---|---|---|
| CN | 102159906 | A | 8/2011 |
| CN | 202833168 | U | 3/2013 |
| CN | 202946381 | | 5/2013 |
| CN | 202946381 | U | 5/2013 |
| CN | 202954971 | | 5/2013 |
| CN | 202954971 | U | 5/2013 |
| CN | 103185007 | A | 7/2013 |
| CN | 203335401 | U | 12/2013 |
| CN | 103953544 | | 7/2014 |
| CN | 203906282 | | 10/2014 |
| EP | 1992820 | A1 | 11/2008 |
| JP | S5612085 | A | 2/1981 |
| JP | S5910792 | A | 1/1984 |
| JP | S5928694 | U | 2/1984 |
| JP | H05106576 | | 4/1993 |
| JP | H5106576 | A | 4/1993 |
| JP | H05106576 | A | 4/1993 |
| JP | 2002303284 | | 10/2002 |
| JP | 2002303284 | A | 10/2002 |
| JP | 2003286981 | | 10/2003 |
| JP | 2003286981 | A | 10/2003 |
| WO | 2013005568 | A1 | 1/2013 |

OTHER PUBLICATIONS

Japanese Office Action issued by the Japanese Patent Office (Japanese language) for Japanese Patent Application No. 2016-561371, dated May 30, 2017, 3 pages.

English translation of Japanese Office Action issued by the Japanese Patent Office for Japanese Patent Application No. 2016-561371, dated May 30, 2017, 3 pages.

International Search Report issued by the International Bureau of WIPO (Chinese Language); dated Jun. 29, 2015; for International Patent Application PCT/CN2015/076290; 13 pages.

English translation of International Search Report issued by the International Bureau of WIPO; dated Jun. 29, 2015; for International Patent Application PCT/CN2015/076290; 3 pages.

First Examination Report dated Jul. 28, 2015, issued by the State Intellectual Property Office (in Chinese language) of the People's Republic of China, for Chinese Patent Application No. 201410143626.8; 5 pages.

English translation of First Examination Report dated Jul. 28, 2015, issued by the State Intellectual Property Office of the People's Republic of China, for Chinese Patent Application No. 201410143626.8; 6 pages.

European Search Report issued by the European Patent Office regarding European Application No. 15777291.4, dated Oct. 11, 2017, 7 pages.

Qfq9, "Two-Stage Compressor," Baidu Library, China, Mar. 17, 2012 (from a website).

* cited by examiner

COMPRESSOR AND AIR CONDITIONER

This application is the national phase of International Application No. PCT/CN2015/076290, titled "COMPRESSOR AND AIR CONDITIONER", filed on Apr. 10, 2015, which claims the benefit of priority to Chinese Patent Application No. 201410143626.8 titled "COMPRESSOR AND AIR CONDITIONER", filed with the Chinese State Intellectual Property Office on Apr. 10, 2014, the entire disclosure of which is incorporated herein by reference.

FIELD

The present application relates to the field of refrigeration, and particularly to a rolling rotor-type three-cylinder double-stage enthalpy increasing compressor with variable capacity and an air conditioner.

BACKGROUND

As the ambient temperature drops, the specific volume of a refrigerant increases, and the unit air intake capacity of a compressor is reduced, resulting in a substantial decline of a heating capacity of the compressor. Generally, electrically auxiliary heating is employed to improve the heating capacity of the compressor or a double-stage enthalpy increasing compressor is employed to address the issue of low heating capacity at a low temperature. The method for improving the heating capacity of the compressor by the electrically auxiliary heating has a low energy efficiency Since the displacement of a conventional double-stage enthalpy increasing compressor is not adjustable, the conventional double-stage enthalpy increasing compressor has a poor adaptability to operating conditions, and if the heating capacity and energy efficiency of the compressor under a working condition with a low temperature are ensured, the energy efficiency of the compressor operating in a normal working condition may decline significantly.

SUMMARY

In view of the present situation of the conventional technology, an object of the present application is to provide a compressor and an air conditioner, in which the number of working cylinders of a multi-cylinder compressor can be flexibly adjusted, thereby improving the adaptability of the compressor to working conditions. To achieve the above object, the following technical solutions of the present application are provided.

A compressor includes a low-pressure stage cylinder, a first high-pressure stage cylinder, a second high-pressure stage cylinder and a lower flange;

the low-pressure stage cylinder, the first high-pressure stage cylinder and the second high-pressure stage cylinder are stacked, and a partition is arranged between each two adjacent cylinders, the first high-pressure stage cylinder and the second high-pressure stage cylinder are both situated at a same side of the low-pressure stage cylinder or the first high-pressure stage cylinder and the second high-pressure stage cylinder are respectively situated at two sides of the low-pressure stage cylinder, the lower flange is situated below the low-pressure stage cylinder, the first high-pressure stage cylinder and the second high-pressure stage cylinder;

the first high-pressure stage cylinder has a first sliding sheet slot, and a first sliding sheet is provided in the first sliding sheet slot, the second high-pressure stage cylinder has a second sliding sheet slot, and a second sliding sheet is provided in the second sliding sheet slot, the low-pressure stage cylinder has a third sliding sheet slot, and a third sliding sheet is provided in the third sliding sheet slot, and the first high-pressure stage cylinder and the second high-pressure stage cylinder are arranged in parallel, and the first high-pressure stage cylinder and the second high-pressure stage cylinder arranged in parallel are connected to the low-pressure stage cylinder in series, the first high-pressure stage cylinder and/or the second high-pressure stage cylinder is a variable capacity cylinder, and the low-pressure stage cylinder functions as a first-stage compression cylinder.

Preferably, two of the partitions are respectively a first partition and a second partition, and the first partition and/or the second partition is provided with a sliding-sheet control device configured to control a movement of a respective sliding sheet; or, the first partition and/or the lower flange is provided with the sliding-sheet control device; or, the second partition and/or the lower flange is provided with the sliding-sheet control device; and each of the sliding-sheet control devices corresponds to one of the sliding sheets, Preferably, the first high-pressure stage cylinder and the second high-pressure stage cylinder are both situated at an upper side of the low-pressure stage cylinder, and the first partition and/or the second partition is provided with the sliding-sheet control device, and the first high-pressure stage cylinder and/or the second high-pressure stage cylinder functions as an unloadable cylinder.

Preferably, the first high-pressure stage cylinder and the second high-pressure stage cylinder are both situated at a lower side of the low-pressure stage cylinder, and a lower one of the first partition and the second partition is provided with the sliding-sheet control device and/or the lower flange is provided with the sliding-sheet control device, and the first high-pressure stage cylinder and/or the second high-pressure stage cylinder functions as an unloadable cylinder.

Preferably, the low-pressure stage cylinder is situated between the first high-pressure stage cylinder and the second high-pressure stage cylinder, an upper one of the first partition and the second partition is provided with the sliding-sheet control device and/or the lower flange is provided with the sliding-sheet control device, and the first high-pressure stage cylinder and or the second high-pressure stage cylinder functions as an unloadable cylinder.

Preferably, the lower flange is provided with a middle chamber.

Preferably, the sliding-sheet control device includes a pin and an elastic restoring element, and the elastic restoring element is arranged at a tail of the pin, and the first sliding sheet and/or the second sliding sheet is provided with a locking slot, the pin is configured to cooperate with the locking slot, and in a case that the pin is situated in the locking slot, the sliding sheet is locked, and in a case that the pin is disengaged from the locking slot, the sliding sheet is unlocked.

Further, the first partition and/or the second partition is provided with a through hole corresponding to the locking slot; or, the first partition and/or the lower flange is provided with a through hole corresponding to the locking slot; or, the second partition and/or the lower flange is provided with a through hole corresponding to the locking slot; and the pin is situated in the through hole, and is in a sealed cooperation with the through hole, and the pin is movable in an axial direction of the through hole.

Further, the low-pressure stage cylinder, the first high-pressure stage cylinder or the second high-pressure stage cylinder is further provided with a groove corresponding to the through hole, and the groove is in communication with the through hole to form a cavity, and the cavity is configured to communicate with a control pipeline.

Preferably, the compressor has a first working mode, a second working mode and a third working mode, in the first working mode, the first sliding sheet, the second sliding sheet and the third sliding sheet are all in a free state, and the low-pressure stage cylinder performs a first-stage compression, and the first high-pressure stage cylinder and the second high-pressure stage cylinder both perform a second-stage compression;

in the second working mode, the first sliding sheet or the second sliding sheet is in a locked state, and the low-pressure stage cylinder performs a first-stage compression, and the second high-pressure stage cylinder or the first high-pressure stage cylinder performs a second-stage compression; and in the third working mode, the first sliding sheet and the second sliding sheet are both in a locked state, and the low-pressure stage cylinder performs a first-stage compression, and the first high-pressure stage cylinder and the second high-pressure stage cylinder are both in an unloaded state.

The present application further relates to an air conditioner, which includes a compressor, and the compressor is the compressor according to any one of the above technical solutions.

The present application has the following beneficial effects.

In the compressor and the air conditioner according to the present application, the first high-pressure stage cylinder and/or the second high-pressure stage cylinder is a variable capacity cylinder, thus, the number of working cylinders of a multi-cylinder compressor can be conveniently and flexibly adjusted, and the adaptability of the compressor to working conditions is thus improved. In a normal working condition (with a light load), one or more high-pressure stage cylinders are unloaded, thereby improving energy efficiency of the compressor, and enhancing comprehensive energy efficiency of the compressor; and in a working condition with a low temperature (with a heavy load), the number of high-pressure stage cylinders that are working is increased, thereby significantly improving the heating capacity of the compressor.

DETAILED DESCRIPTION

Figure 1:
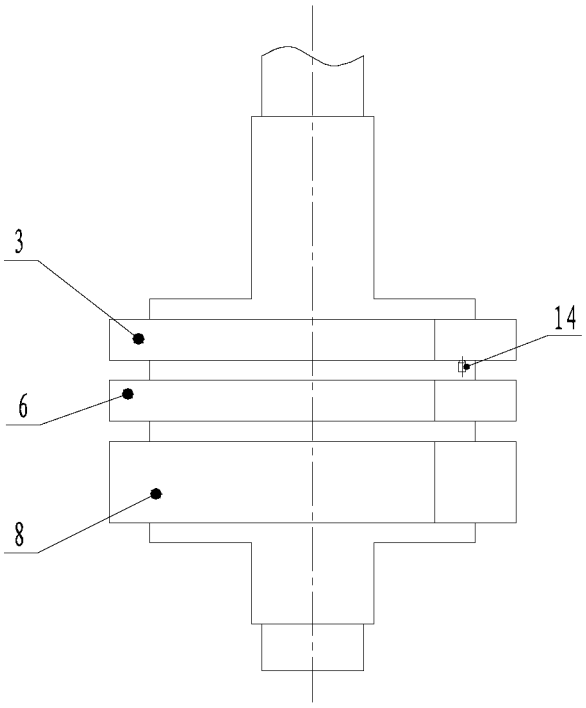
FIGS. 1 to 6 are schematic views showing various arrangements of cylinders in a pump body of the compressor according to the present application.

In order to make the object, technical solutions and advantages of the present application clearer and readily understandable, the compressor and the air conditioner according to the present application are further described in detail hereinafter in conjunction with drawings and embodiments. In should be understood that, the embodiments described here are only intended to explain the present application, and are not intended to limit the present application.

Referring to FIGS. 1 to 19, a pump body of an embodiment of a compressor according to the present application includes a crank shaft 1, an upper flange, a low-pressure stage cylinder 8, a first high-pressure stage cylinder 3, a second high-pressure stage cylinder 6 and a lower flange 9. The low-pressure stage cylinder 8, the first high-pressure stage cylinder 3 and the second high-pressure stage cylinder 6 are stacked, and a partition is arranged between each two adjacent cylinders. The first high-pressure stage cylinder 3 and the second high-pressure stage cylinder 6 are both situated at the same side of the low-pressure stage cylinder 8 or are respectively situated at two sides of the low-pressure stage cylinder 8. The lower flange 9 is situated below the low-pressure stage cylinder 8, the first high-pressure stage cylinder 3 and the second high-pressure stage cylinder 6. The lower flange 9 is provided with a middle chamber 19, and is provided with a cover plate 10 at a lower end. The first high-pressure stage cylinder 3 has a first sliding sheet slot (not shown), and a first sliding sheet 15 is provided in the first sliding sheet slot. The second high-pressure stage cylinder 6 has a second sliding sheet slot (not shown), and a second sliding sheet 17 is provided in the second sliding sheet slot. The low-pressure stage cylinder 8 has a third sliding sheet slot (not shown), and a third sliding sheet is provided in the third sliding sheet slot. The first high-pressure stage cylinder 3 and the second high-pressure stage cylinder 6 are arranged in parallel, and the first high-pressure stage cylinder 3 and the second high-pressure stage cylinder 6 arranged in parallel are connected to the low-pressure stage cylinder 8 in series. The first high-pressure stage cylinder 3 and/or the second high-pressure stage cylinder 6 is a variable capacity cylinder. The low-pressure stage cylinder 8 functions as a first-stage compression cylinder.

As an implementable embodiment, the two partitions are respectively a first partition and a second partition, and the first partition and/or the second partition is provided with a sliding-sheet control device configured to control the movement of a respective sliding sheet; or, the first partition and/or the lower flange 9 is provided with the sliding-sheet control device; or, the second partition and/or the lower flange 9 is provided with the sliding-sheet control device. Each of the sliding-sheet control devices corresponds to one sliding sheet. Preferably, the sliding-sheet control device includes a pin 14 and an elastic restoring element 13, and the elastic restoring element 13 is arranged at a tail of the pin 14. The elastic restoring element 13 may be a spring.

The first sliding sheet 15 and/or the second sliding sheet 17 is provided with a locking slot (not indicated), and the pin 14 is configured to cooperate with a respective locking slot. When the pin 14 is situated in the locking slot, the sliding sheet corresponding to the pin 14 is locked, and when the pin 14 is disengaged from the locking slot, the sliding sheet corresponding to the pin 14 is unlocked to be in a free state.

Further, the first partition and/or the second partition is provided with a through hole corresponding to the locking slot; or, the first partition and/or the lower flange is provided with a through hole corresponding to the locking slot; or, the second partition and/or the lower flange 9 is provided with a through hole corresponding to the locking slot. The pin 14 is situated in the through hole, and is in a sealed cooperation with the through hole, and the pin 14 is movable in an axial direction of the through hole.

The low-pressure stage cylinder 8, the first high-pressure stage cylinder 3 or the second high-pressure stage cylinder 6 is further provided with a groove corresponding to the through hole and the groove is in communication with the through hole to form a cavity. The cavity is configured to communicate with a control pipeline, and the refrigerant within the control pipeline can change the pressure difference between two sides of the pin 14, thereby driving the pin 14 to act.

Figure 2:
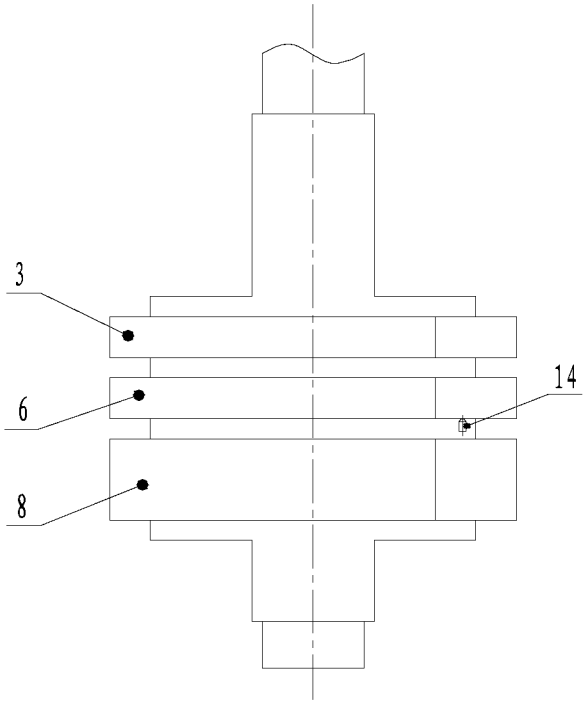
Figure 3:
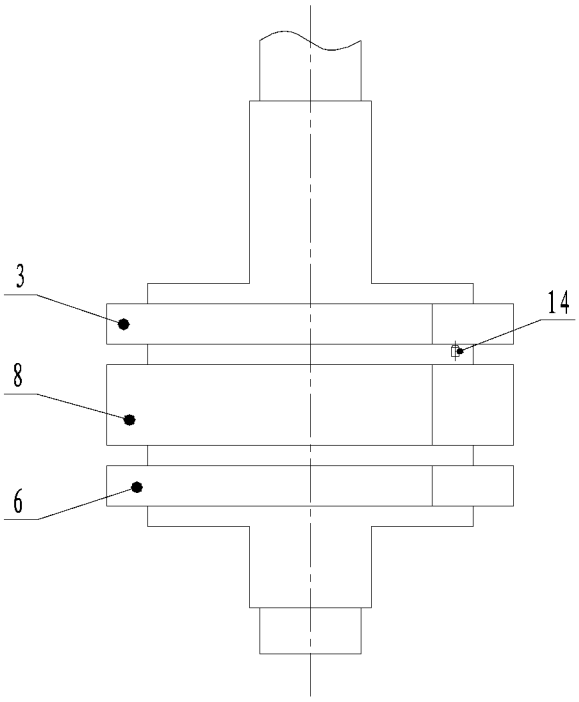
Figure 4:
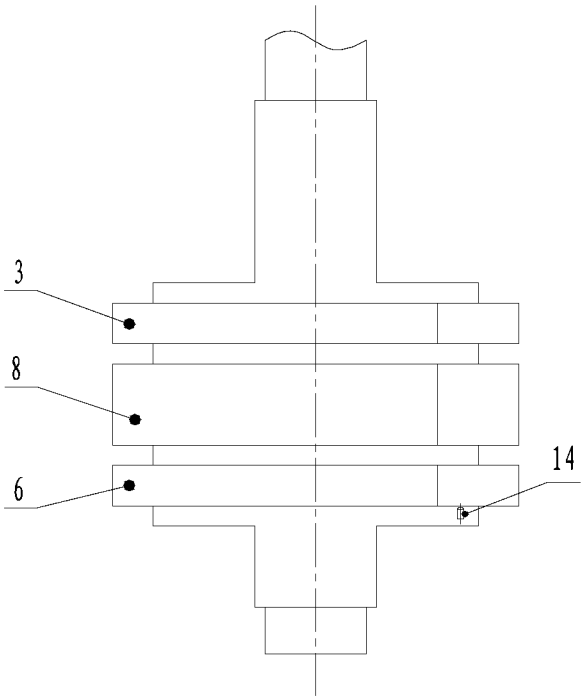
Figure 13:
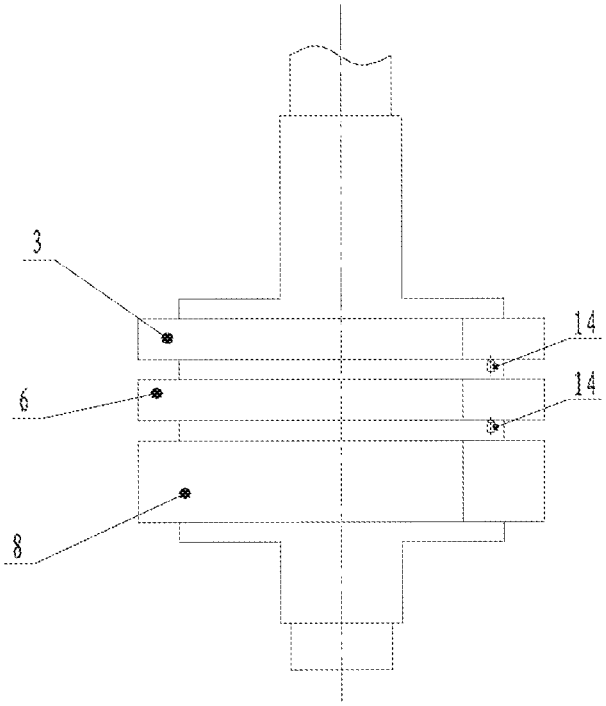
FIGS. 13 to 15 are schematic views showing the structure of the pump body of the compressor in FIGS. 1 to 6 having two sliding-sheet control device.
Figure 14:
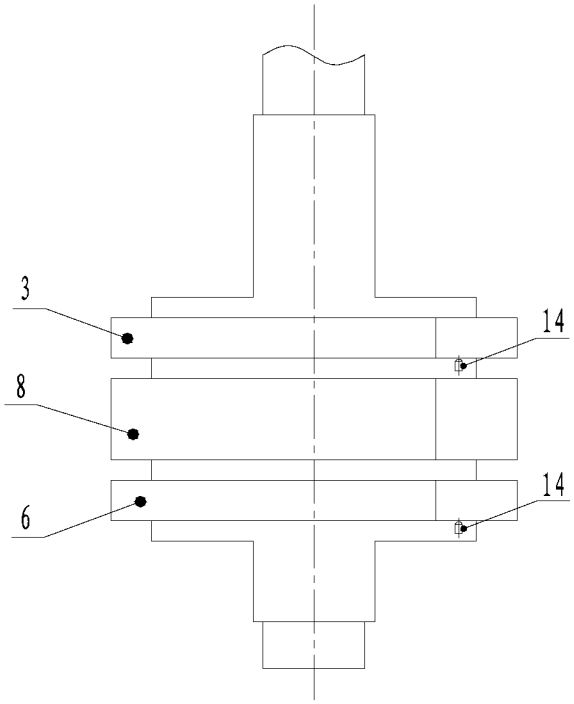

As an implementable embodiment, as shown in FIGS. 1, 2, and 13, the first high-pressure stage cylinder 3 and the second high-pressure stage cylinder 6 are both situated at an upper side of the low-pressure stage cylinder 8. The first partition and/or the second partition is provided with a sliding-sheet control device, and the first high-pressure stage cylinder 3 and/or the second high-pressure stage cylinder 6 functions as an unloadable cylinder. The first partition here is the partition between the first high-pressure stage cylinder 3 and the second high-pressure stage cylinder 6, and the second partition here is the partition between the second high-pressure stage cylinder 6 and the low-pressure stage cylinder 8.

Figure 5:
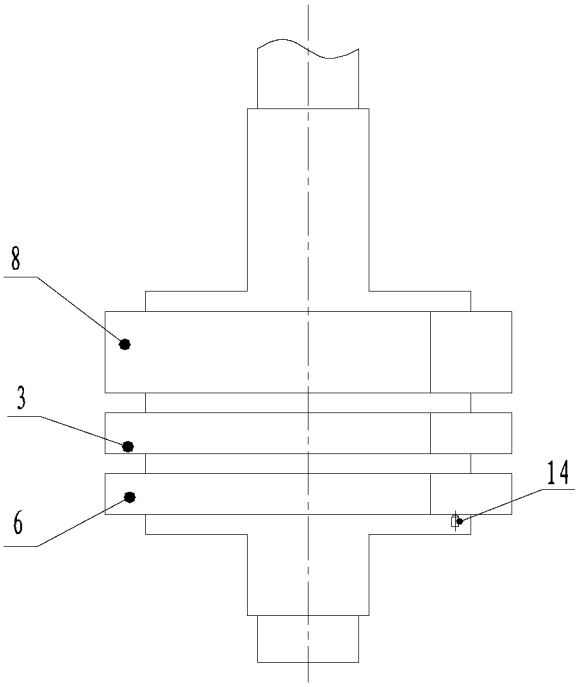
Figure 6:
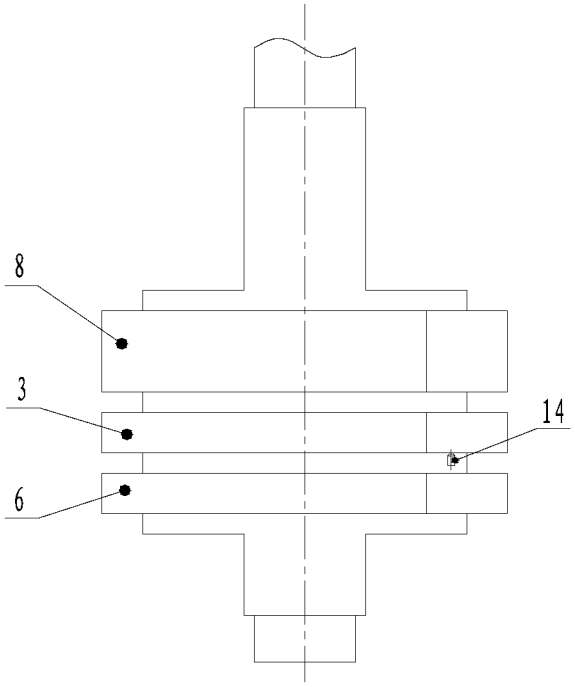
Figure 7:
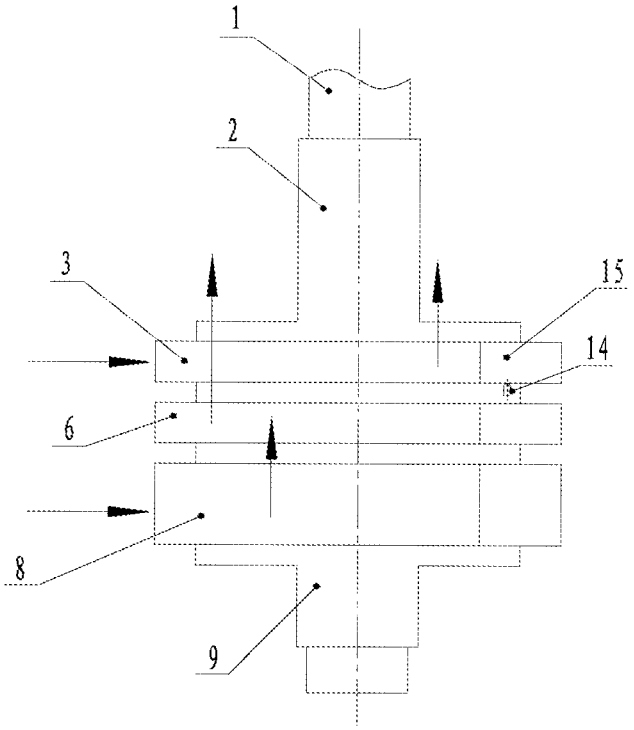
FIG. 7 is a schematic view showing a flowing direction of a refrigerant according to a first embodiment of the pump body of the compressor in FIG. 1.
Figure 8:
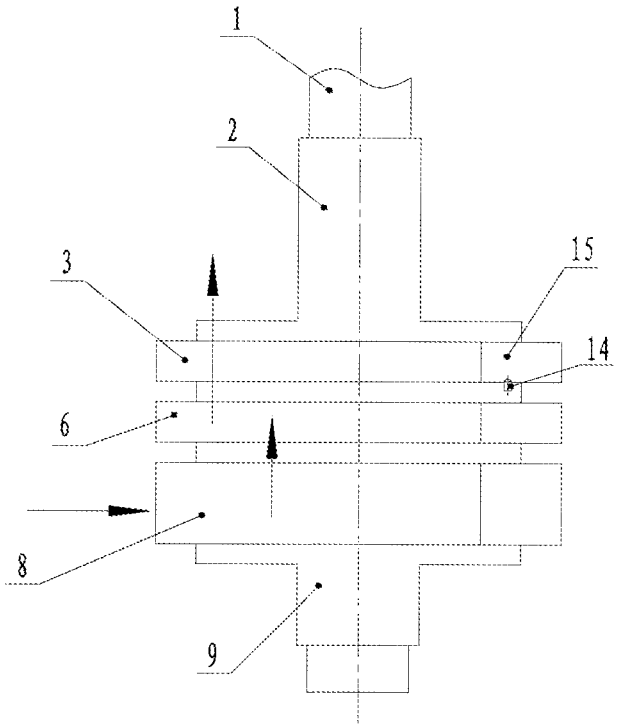
FIG. 8 is a schematic view showing a flowing direction of a refrigerant according to a second embodiment of the pump body of the compressor in FIG. 1.
Figure 9:
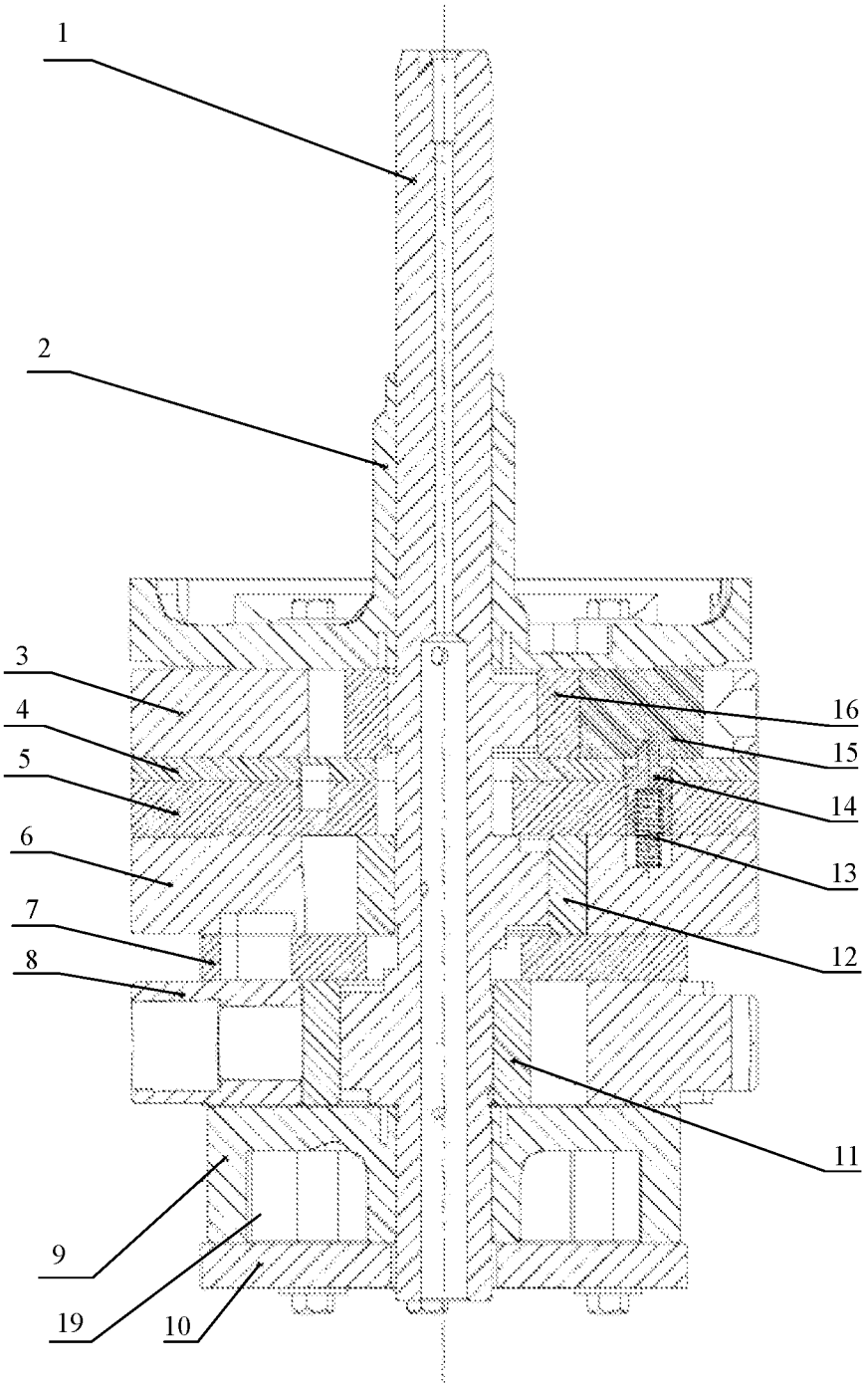
FIG. 9 is a schematic sectional view of the pump body of the compressor in FIG. 8 with a first sliding sheet in a locked state.
Figure 10:
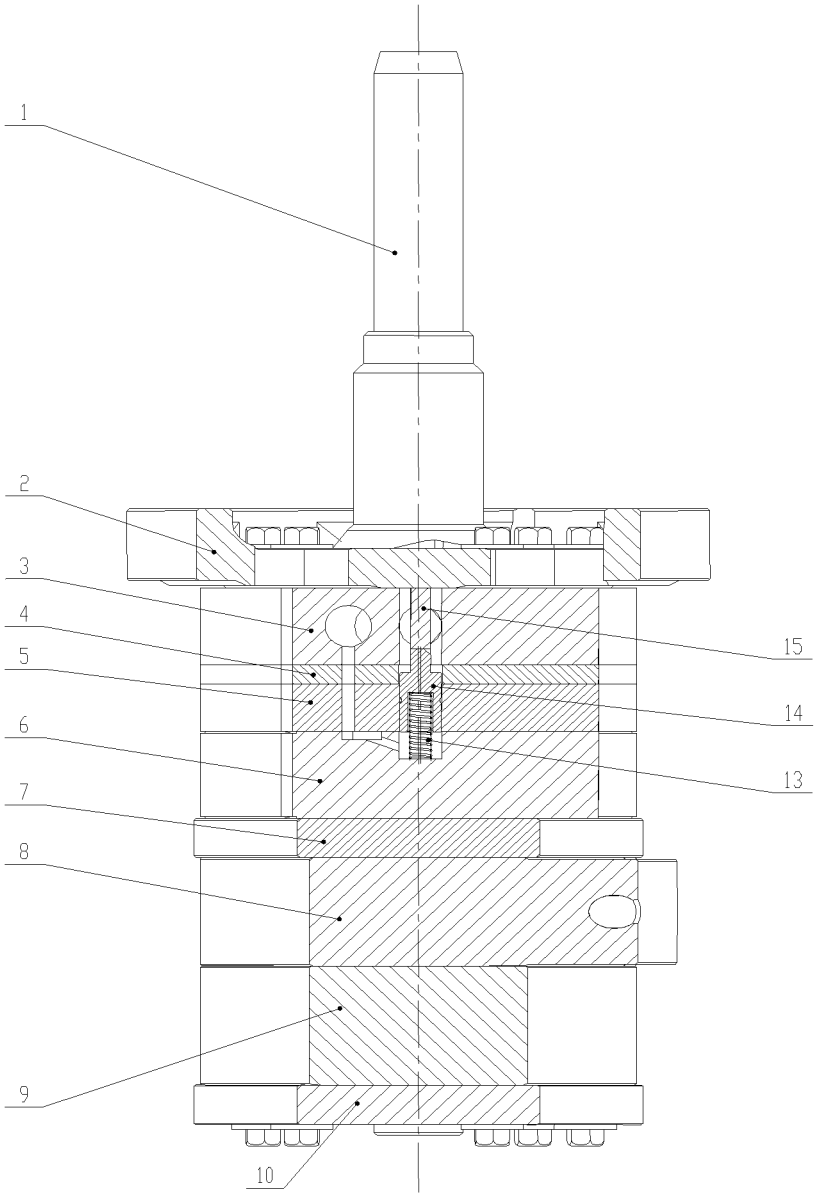
FIG. 10 is a schematic sectional view, taken in another direction, of the pump body of the compressor in FIG. 8 with the first sliding sheet in the locked state.
Figure 11:
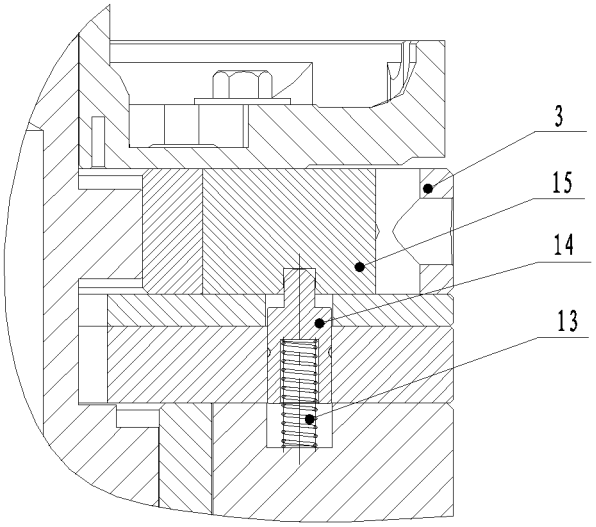
FIG. 11 is a partially enlarged schematic sectional view of the pump body of the compressor in FIG. 8 with the first sliding sheet in the locked state.
Figure 12:
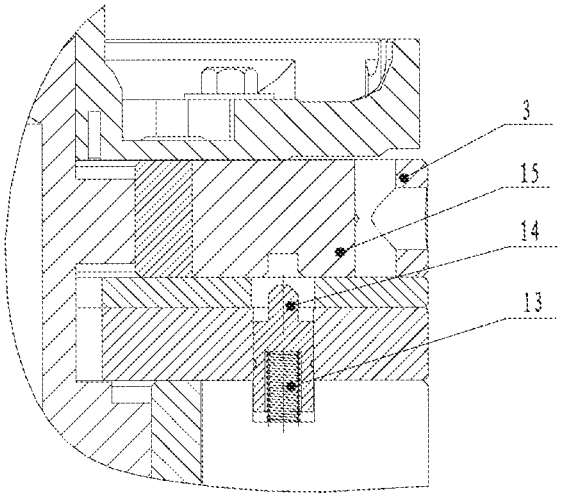
FIG. 12 is a partially enlarged schematic sectional view of the pump body of the compressor in FIG. 8 with the first sliding sheet in a free state.
Figure 15:
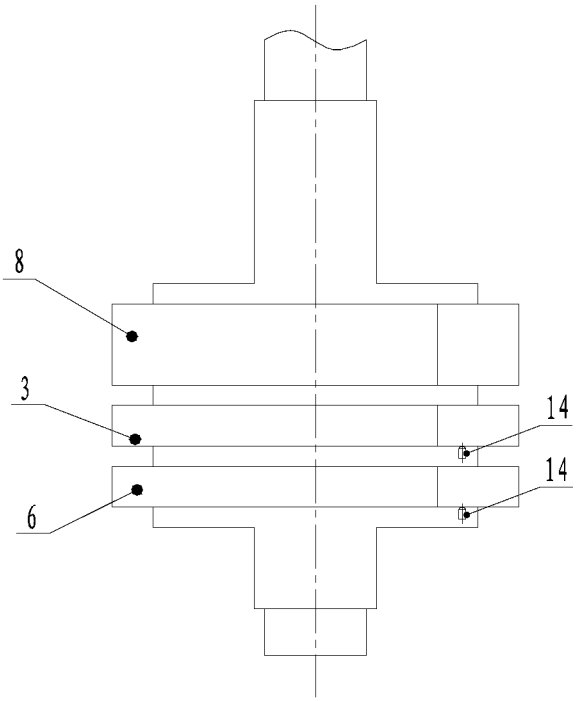

As an implementable embodiment, as shown in FIGS. 5, 6 and 15, the first high-pressure stage cylinder 3 and the second high-pressure stage cylinder 6 are both situated at a lower side of the low-pressure stage cylinder 8, and the lower one of the first partition and the second partition is provided with the sliding-sheet control device and/or the lower flange 9 is provided with the sliding-sheet control device, and the first high-pressure stage cylinder 3 and/or the second high-pressure stage cylinder 6 functions as an unloadable cylinder. The first partition here is the partition between the low-pressure stage cylinder 8 and the first high-pressure stage cylinder 3, and the second partition here is the partition between the first high-pressure stage cylinder 3 and the second high-pressure stage cylinder 6, and the lower one of the first partition and the second partition is just the second partition. Of course, the first partition here may also be the partition between the first high-pressure stage cylinder 3 and the second high-pressure stage cylinder 6, and the second partition here may also be the partition between the low-pressure stage cylinder 8 and the first high-pressure stage cylinder 3, and the lower one of the first partition and the second partition is the first partition.

As an implementable embodiment, as shown in FIGS. 3, 4, 9 and 14, the low-pressure stage cylinder 8 is situated between the first high-pressure stage cylinder 3 and the second high-pressure stage cylinder 6. A lower roller 11 is provided in the low-pressure stage cylinder, an upper roller 16 is provided in the first high-pressure stage cylinder, and a middle roller 12 is provided in the second high-pressure stage cylinder 6. The upper one of the first partition and the second partition is provided with the sliding-sheet control device and/or the lower flange 9 is provided with the sliding-sheet control device, and the first high-pressure stage cylinder 3 and/or the second high-pressure stage cylinder 6 functions as an unloadable cylinder. The first partition here is the partition between the first high-pressure stage cylinder 3 and the low-pressure stage cylinder 8 (the upper partition 4 and the middle partition 5 are formed integrally), and the second partition is the partition (the lower partition 7) between the second high-pressure stage cylinder 6 and the low-pressure stage cylinder 8, and the upper one of the first partition and the second partition is just the first partition. Of course, the first partition here may also be the partition between the second high-pressure stage cylinder 6 and the low-pressure stage cylinder 8, and the second partition here may also be the partition between the first high-pressure stage cylinder 3 and the low-pressure stage cylinder 8, and the upper one of the first partition and the second partition is the second partition.

The compressor according to the above embodiments has a first working mode, a second working mode and a third working mode.

Figure 16:
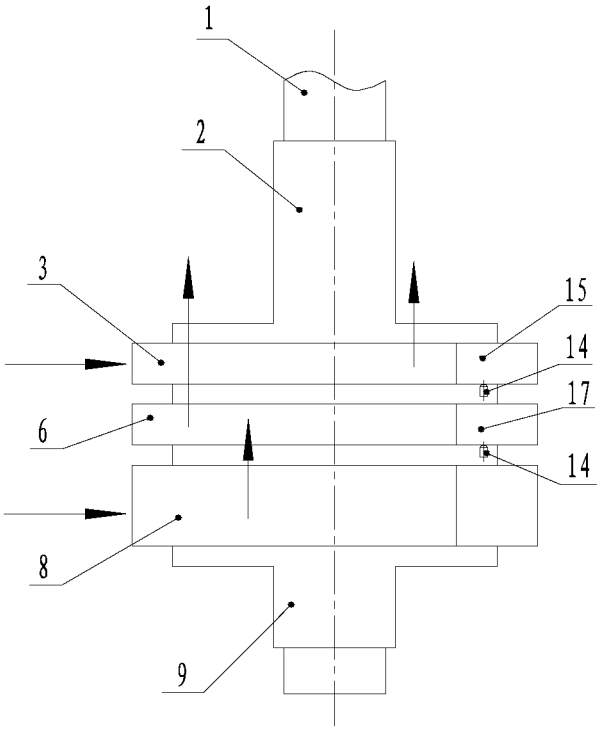
FIG. 16 is a schematic view showing the structure of the pump body of the compressor in FIG. 13 with the first sliding sheet and a second sliding sheet both in a free state.

In the first working mode (a three-cylinder double-stage mode), taking the first high-pressure stage cylinder 3 and the second high-pressure stage cylinder 6 being both situated at the upper side of the low-pressure stage cylinder 8 as an example, as shown in FIG. 16, the first sliding sheet 15, the second sliding sheet 1 and the third sliding sheet are all in a free state, and the low-pressure stage cylinder 8 performs a first-stage compression, and the first high-pressure stage cylinder 3 and the second high-pressure stage cylinder 6 both perform a second-stage compression. The refrigerant coming from the evaporator enters a liquid separator and then enters the low-pressure stage cylinder 8, and is compressed for the first time in the low-pressure stage cylinder 8 and then discharged into the middle chamber, the refrigerant compressed for the first time is mixed in the middle chamber with the refrigerant which flashes in a flash vaporizer to have a middle pressure, and the mixed refrigerant enters the first high-pressure stage cylinder 3 and the second high-pressure stage cylinder 6 to be compressed for the second time, and then is directly discharged into a housing of the compressor, thus achieving a three-cylinder double-stage operation. The direction indicated by arrows in the drawing represents the flowing direction of the refrigerant.

Figure 17:
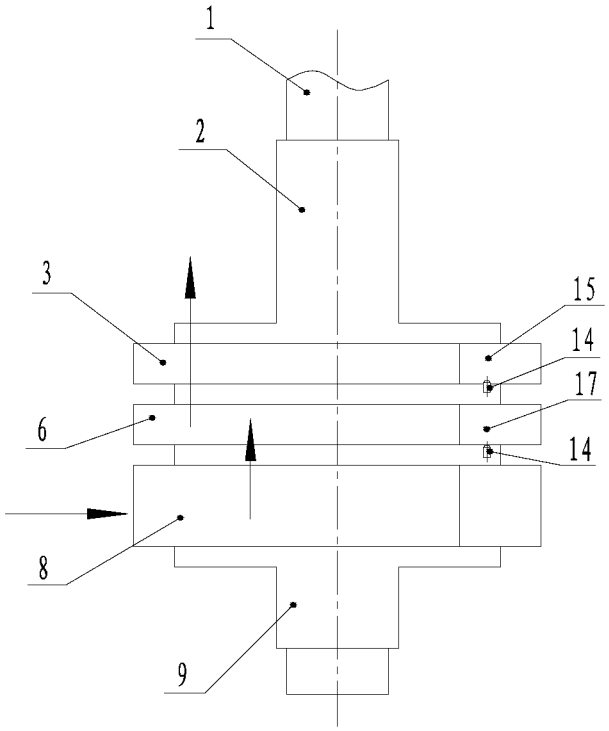
FIG. 17 is a schematic view showing the structure of the pump body of the compressor in FIG. 13 with the first sliding sheet in a locked state and the second sliding sheet in the free state.
Figure 18:
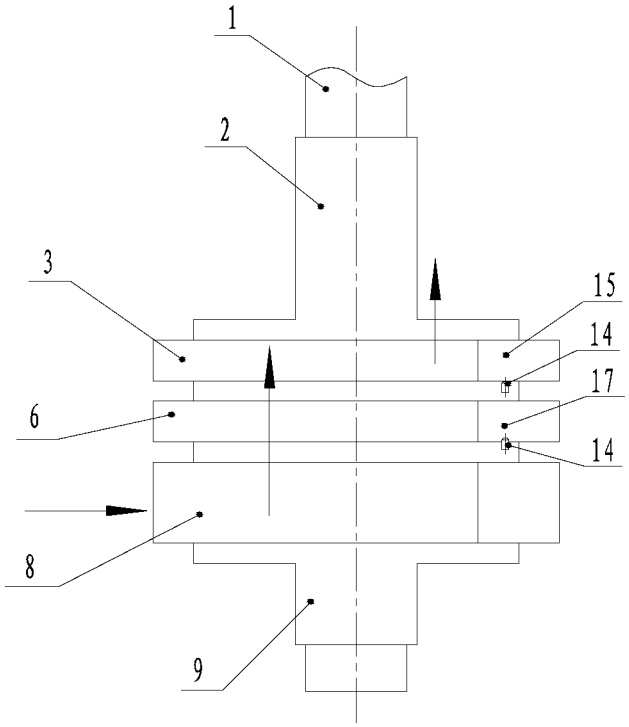
FIG. 18 is a schematic view showing the structure of the pump body of the compressor in FIG. 13 with the first sliding sheet in the free state and the second sliding sheet in the locked state.

In the second working mode (a double-cylinder double-stage mode), taking the first high-pressure stage cylinder 3 and the second high-pressure stage cylinder 6 being both situated at the upper side of the low-pressure stage cylinder 8 as an example, as shown in FIGS. 17 and 18, the first sliding sheet 15 or the second sliding sheet 17 is in a locked state, and the low-pressure stage cylinder 8 performs a first-stage compression, and the second high-pressure stage cylinder 6 or the first high-pressure stage cylinder 3 performs a second-stage compression. The refrigerant coming from the evaporator enters the liquid separator and then enters the low-pressure stage cylinder 8 to be compressed for the first time and then is discharged into the middle chamber after being compressed, the refrigerant compressed for the first time is mixed with the refrigerant which flashes in the flash vaporizer to have a middle pressure, and the mixed refrigerant enters the first high-pressure stage cylinder 3 or the second high-pressure stage cylinder 6 to be compressed for the second time, and then is directly discharged into the housing of the compressor, thus achieving the double-cylinder double-stage operation. The direction indicated by the arrows in the drawing represents the flowing direction of the refrigerant.

Figure 19:
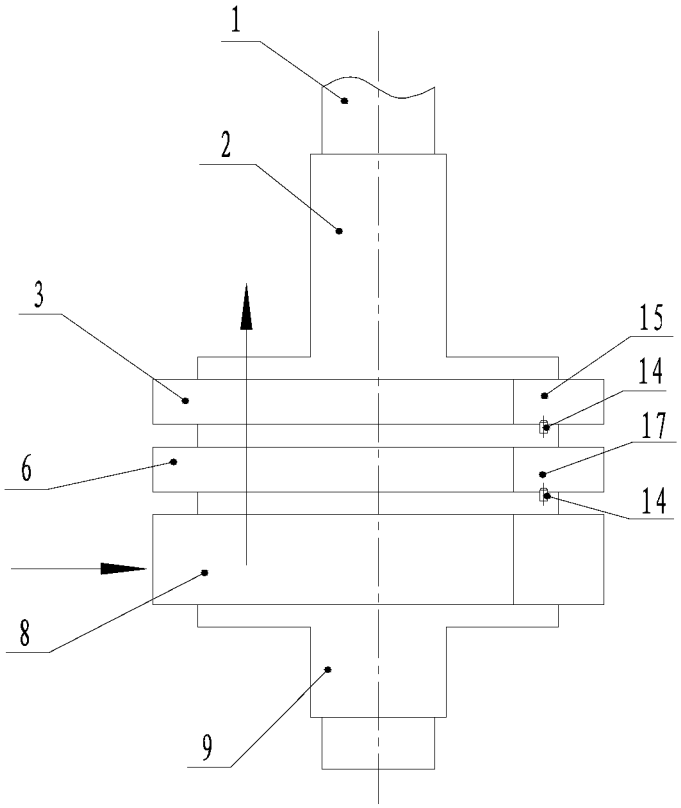
FIG. 19 is a schematic view showing the structure of the pump body of the compressor in FIG. 13 with the first sliding sheet and the second sliding sheet both in the flocked state.
Figure 20:
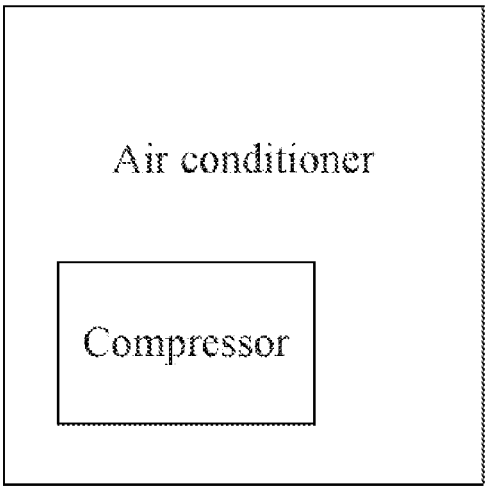
FIG. 20 is a schematic view showing an air conditioner including the compressor of the present application.

In the third working mode (a single-cylinder single-stage mode), taking the first high-pressure stage cylinder 3 and the second high-pressure stage cylinder 6 being both situated at the upper side of the low-pressure stage cylinder 8 as an example, as shown in FIG. 19, the first sliding sheet 15 and the second sliding sheet 17 are both in a locked state, and the third sliding sheet is in a free state, the low-pressure stage cylinder 8 performs a first-stage compression, and the first high-pressure stage cylinder 3 and the second high-pressure stage cylinder 6 are both in an unloaded state.

The present application further relates to an air conditioner, which includes the compressor according to any one of the above technical solutions. Other parts, except for the compressor, of the air conditioner are all conventional technology, and thus are not described here in detail.

In the compressor and the air conditioner according to the above embodiments, the first high-pressure stage cylinder and/or the second high-pressure stage cylinder is a variable capacity cylinder, and the number of working cylinders of the multi-cylinder compressor can be conveniently and flexibly adjusted, thereby improving the adaptability of the compressor to working conditions. In a normal working condition (with a light load), one or more high-pressure stage cylinders are unloaded, thus improving the energy efficiency of the compressor, and improving the comprehensive energy efficiency of the compressor. In a low temperature working condition with a heavy load), the number of the high-pressure stage cylinders is increased, which can significantly improve the heating capacity of the compressor.

The above embodiments only demonstrates several embodiments of the present application. The description of the embodiments is detailed and specific, however, it cannot consider that these embodiments constitute a limitation to the scope of the present application. It should be noted that, for the person skilled in the art, several variations and modifications may further be made without departing from the concept of the present application, and all these variations and modifications fall into the scope of the present application. Therefore, the scope of the present application is defined by the attached claims.

What is claimed is:

1. A compressor, comprising:

a single low-pressure stage cylinder and two high-pressure stage cylinders, wherein the two high-pressure stage cylinders include a first high-pressure stage cylinder and a second high-pressure stage cylinder;

a roller is provided in the low-pressure stage cylinder, the first high-pressure stage cylinder, and the second high-pressure stage cylinder;

a lower flange, wherein the lower flange is provided with a middle chamber, and the middle chamber is so arranged that refrigerant moves from the low-pressure stage cylinder to the first high-pressure stage cylinder and/or the second high-pressure stage cylinder via the middle chamber within the compressor;

wherein the low-pressure stage cylinder, the first high-pressure stage cylinder and the second high-pressure stage cylinder are stacked, and an upper partition is arranged between the first and second high-pressure stage cylinders and a lower partition is arranged between the first high-pressure stage cylinder and the low-pressure stage cylinder, the first high-pressure stage cylinder and the second high-pressure stage cylinder are both situated at a same side of the low-pressure stage cylinder;

wherein the lower flange is situated below the low-pressure stage cylinder, the first high-pressure stage cylinder and the second high-pressure stage cylinder;

wherein the first high-pressure stage cylinder has a first sliding sheet slot, and a first sliding sheet is provided in the first sliding sheet slot, the second high-pressure stage cylinder has a second sliding sheet slot, and a second sliding sheet is provided in the second sliding sheet slot, the low-pressure stage cylinder has a third sliding sheet slot, and a third sliding sheet is provided in the third sliding sheet slot; and wherein the first high-pressure stage cylinder and the second high-pressure stage cylinder are arranged in parallel, and the first high-pressure stage cylinder and the second high-pressure stage cylinder arranged in parallel are connected to the low-pressure stage cylinder in series, and the low-pressure stage cylinder functions as a first-stage compression cylinder;

wherein the first high-pressure stage cylinder and the second high-pressure stage cylinder function as an unloadable cylinder via a first pin engaging the first sliding sheet to change a state of the first sliding sheet from a free state to a locked state and/or a second pin engaging the second sliding sheet to change a state of the first sliding sheet from a free state to a locked state to adjust a number of loaded high-pressure stage cylinders while keeping the low-pressure stage cylinder loaded, wherein the first pin is biased toward the first sliding sheet by a first spring and the second pin is biased toward the second sliding sheet by a second spring;

wherein the second high-pressure stage cylinder includes a chamber, the first spring has a first end engaging the first pin and an opposite second end disposed in the chamber, a first vertical passage extends through the upper partition to connect the first high-pressure stage cylinder to the second high-pressure stage cylinder and a second passage sloping upward from the chamber toward the first passage to connect the chamber to the first vertical passage;

the first sliding sheet, the second sliding sheet and the third sliding sheet being configured in such a way that:

in a first working mode of the compressor, the first sliding sheet is in the locked state, and both of the second sliding sheet and the third sliding sheet are in the free state where second pin is not engaged with the second sliding sheet; and in a second working mode of the compressor, all of the first sliding sheet, the second sliding sheet and the third sliding sheet are in the free state, wherein a load on the compressor in the second working mode is greater than the load on the compressor in the first working mode.

2. The compressor according to claim 1, wherein the first high-pressure stage cylinder and the second high-pressure stage cylinder are both situated at an upper side of the low-pressure stage cylinder.

3. The compressor according to claim 1, wherein, the compressor has a third working mode; in the first working mode, the low-pressure stage cylinder performs a first stage compression, and the first high-pressure stage cylinder and the second high-pressure stage cylinder both perform a second-stage compression;

in the second working mode, the low-pressure stage cylinder performs a first-stage compression, and the second high-pressure stage cylinder or the first high-pressure stage cylinder performs a second-stage compression; and in the third working mode, the first sliding sheet and the second sliding sheet are both in the locked state, and the low-pressure stage cylinder performs a first-stage compression, and the first high-pressure stage cylinder and the second high-pressure stage cylinder are both in an uploaded state.

4. An air conditioner, comprising a compressor, and the compressor comprising:

a single low-pressure stage cylinder and two high-pressure stage cylinders, wherein the two high-pressure stage cylinders include a first high-pressure stage cylinder—and a second high-pressure stage cylinder;

a roller is provided in the low-pressure stage cylinder, the first high-pressure stage cylinder, and the second high-pressure stage cylinder;

a lower flange, wherein the lower flange is provided with a middle chamber, and the middle chamber is so arranged that refrigerant moves from the low pressure stage cylinder to the first high-pressure stage cylinder and/or the second high-pressure stage cylinder via the middle chamber within the compressor;

wherein the low-pressure stage cylinder, the first high-pressure stage cylinder and the second high-pressure stage cylinder are stacked, and an upper partition is arranged between the first and second high-pressure stage cylinders and a lower partition is arranged between the first high-pressure stage cylinder and the low-pressure stage cylinder, the first high-pressure stage cylinder and the second high-pressure stage cylinder are both situated at a same side of the low-pressure stage cylinder;

wherein the lower flange is situated below the low-pressure stage cylinder, the first high-pressure stage cylinder and the second high-pressure stage cylinder;

wherein the first high-pressure stage cylinder has a first sliding sheet slot, and a first sliding sheet is provided in the first sliding sheet slot, the second high-pressure stage cylinder has a second sliding sheet slot, and a second sliding sheet is provided in the second sliding sheet slot, the low-pressure stage cylinder has a third sliding sheet slot, and a third sliding sheet is provided in the third sliding sheet slot; and wherein the first high-pressure stage cylinder and the second high-pressure stage cylinder are arranged in parallel, and the first high-pressure stage cylinder and the second high-pressure stage cylinder arranged in parallel are connected to the low-pressure stage cylinder in series, and the low-pressure stage cylinder functions as a first-stage compression cylinder;

wherein the first high-pressure stage cylinder and the second high-pressure stage cylinder function as an unloadable cylinder via a first pin engaging the first sliding sheet to change a state of the first sliding sheet from a free state to a locked state and a second pin engaging the second sliding sheet to change a state of the first sliding sheet from a free state to a locked state to adjust a number of loaded high-pressure stage cylinders while keeping the low-pressure stage cylinder loaded, wherein the first pin is biased toward the first sliding sheet by a first spring and the second pin is biased toward the second sliding sheet by a second spring;

wherein the second high-pressure stage cylinder includes a chamber, the first spring has a first end engaging the first pin and an opposite second end disposed in the chamber, a first vertical passage extends through the upper partition to connect the first high-pressure stage cylinder to the second high-pressure stage cylinder and a second passage sloping upward from the chamber toward the first passage to connect the chamber to the first vertical passage;

the first sliding sheet, the second sliding sheet and the third sliding sheet being configured in such a way that:

in a first working mode of the compressor, the first sliding sheet is in the locked state, and both of the second sliding sheet and the third sliding sheet are in the free state where second pin is not engaged with the second sliding sheet; and in a second working mode of the compressor, all of the first sliding sheet, the second sliding sheet and the third sliding sheet are in the free state, wherein a load on the compressor in the second working mode is greater than the load on the compressor in the first working mode.

5. The compressor according to claim 2, wherein, the compressor has a third working mode; in the first working mode, the low-pressure stage cylinder performs a first-stage compression, and the first high-pressure stage cylinder and the second high-pressure stage cylinder both perform a second-stage compression;

in the second working mode, the low-pressure stage cylinder performs a first-stage compression, and the second high-pressure stage cylinder or the first high-pressure stage cylinder performs a second-stage compression; and in the third working mode, the first sliding sheet and the second sliding sheet are both in the locked state, and the low-pressure stage cylinder performs a first-stage compression, and the first high-pressure stage cylinder and the second high-pressure stage cylinder are both in an unloaded state.

6. The air conditioner according to claim 4, wherein, the compressor has a third working mode; in the first working mode, the low-pressure stage cylinder performs a first-stage compression, and the first high-pressure stage cylinder and the second high-pressure stage cylinder both perform a second-stage compression;

in the second working mode, and the low pressure stage cylinder performs a first-stage compression, and the second high-pressure stage cylinder or the first high-pressure stage cylinder performs a second-stage compression; and in the third working mode, the first sliding sheet and the second sliding sheet are both in the locked state, and the low-pressure stage cylinder performs a first-stage compression, and the first high-pressure stage cylinder and the second high-pressure stage cylinder are both in an unloaded state.

* * * * *